US009130330B2

(12) United States Patent
Menardo et al.

(10) Patent No.: US 9,130,330 B2
(45) Date of Patent: Sep. 8, 2015

(54) ELECTRICAL SWIVEL DESIGN

(75) Inventors: Philippe Albert Christian Menardo, Beaulieu-sur-Mer (FR); Benjamin Maurice Passieux, Saint-Laurent-du-Var (FR)

(73) Assignee: Single Buoy Moorings, Inc., Marly (CH)

( * ) Notice: Subject to any disclaimer, the term of this patent is extended or adjusted under 35 U.S.C. 154(b) by 11 days.

(21) Appl. No.: 13/882,581

(22) PCT Filed: Nov. 2, 2011

(86) PCT No.: PCT/EP2011/069257

§ 371 (c)(1),
(2), (4) Date: Apr. 30, 2013

(87) PCT Pub. No.: WO2012/059518

PCT Pub. Date: May 10, 2012

(65) Prior Publication Data

US 2013/0224968 A1 Aug. 29, 2013

Related U.S. Application Data

(60) Provisional application No. 61/409,356, filed on Nov. 2, 2010.

(51) Int. Cl.

| | |
|---|---|
| ***H01R 3/08*** | (2006.01) |
| ***H01R 13/523*** | (2006.01) |
| ***H01R 35/00*** | (2006.01) |

(Continued)

(52) U.S. Cl.

CPC ..... *H01R 35/00* (2013.01); *B63B 21/00* (2013.01); *B63B 35/00* (2013.01); *H01R 13/53* (2013.01); *H01R 39/646* (2013.01); *H01R 13/523* (2013.01)

(58) Field of Classification Search

CPC ..... H01R 39/646; H01R 3/08; H01R 13/02; H01R 13/523; H01R 13/53

USPC ..... 439/5, 179, 201

See application file for complete search history.

(56) References Cited

U.S. PATENT DOCUMENTS 3,972,577 A * 8/1976 Charles et al. ..... 439/5
4,063,792 A * 12/1977 Lodge ..... 439/5

(Continued)

FOREIGN PATENT DOCUMENTS

DE 102009018655 A1 10/2010
GB 1190034 A 4/1970

(Continued)

OTHER PUBLICATIONS

Hugueny, Bertrand, "International Search Report" for PCT/EP2011/069257, as mailed Jan. 20, 2012, 5 pages.

*Primary Examiner* — Gary Paumen
(74) *Attorney, Agent, or Firm* — Winstead PC

(57) ABSTRACT

High voltage swivel (4) comprising a static (8) and a rotating body (7), the static and the rotating body being rotatable coaxial around a longitudinal axis, wherein the static and the rotating body are in electrical contact one with the other in order to allow transmission of power and/or data between the static and the rotating body, the static and the rotating body each having a contact surface (14, 16) for allowing the electrical contact between the static and the rotating body, wherein the electrical contact between the contact surfaces of the static and the rotating body is obtained by using an electrical conductive fluid (15).

21 Claims, 7 Drawing Sheets

(51) Int. Cl.

| | |
|---|---|
| ***B63B 21/00*** | (2006.01) |
| ***B63B 35/00*** | (2006.01) |
| ***H01R 13/53*** | (2006.01) |
| ***H01R 39/64*** | (2006.01) |

(56) References Cited

U.S. PATENT DOCUMENTS

| | | | | | |
|---|---|---|---|---|---|
| 4,188,523 | A | * | 2/1980 | Kawai et al. | 219/83 |
| 4,484,789 | A | * | 11/1984 | Leitner et al. | 439/5 |
| 4,566,744 | A | * | 1/1986 | v Engelenburg et al. | 439/5 |
| 4,623,514 | A | | 11/1986 | Arora et al. | |
| 4,733,038 | A | * | 3/1988 | Girardin | 219/69.12 |
| 5,498,164 | A | * | 3/1996 | Ward et al. | 439/15 |
| 5,866,967 | A | * | 2/1999 | Sasaki | 310/232 |
| 6,663,395 | B2 | * | 12/2003 | Sobhani | 439/21 |
| 7,137,822 | B1 | | 11/2006 | Longmire et al. | |
| 7,955,105 | B2 | * | 6/2011 | Maeland | 439/191 |
| 7,997,905 | B2 | * | 8/2011 | Denk et al. | 439/5 |
| 8,033,833 | B1 | * | 10/2011 | Lai | 439/5 |
| 8,106,486 | B2 | * | 1/2012 | Yamamoto et al. | 257/625 |

FOREIGN PATENT DOCUMENTS

| | | | |
|---|---|---|---|
| WO | WO-2007/147657 | A1 | 12/2007 |
| WO | WO-2009/036556 | A1 | 3/2009 |
| WO | WO-2010/063715 | A2 | 6/2010 |

* cited by examiner

ELECTRICAL SWIVEL DESIGN

FIELD OF THE INVENTION

The invention relates to a high voltage swivel comprising a static and a rotating body, the static and rotating body being rotatable coaxial around a longitudinal axis, wherein the static and the rotating body are in electrical contact one with the other in order to allow transmission of power and/or data between the static and the rotating body, the static and the rotating body each having a contact surface for allowing the electrical contact between the static and the rotating body.

BACKGROUND OF THE INVENTION

An electric swivel is an electromechanical device that allows the transmission of power and electrical signals from a stationary to a rotating structure. It can be used in any electromechanical system that requires unrestrained, intermittent or continuous rotation while transmitting power and/or data. High voltage (HV) swivel are used offshore in order to transfer power between a static part, usually the part moored to the seabed and a rotating part that moves with the vessel around the single point mooring.

Such a high voltage swivel is known from U.S. Pat. No. 7,137,822 in the name of the applicant. The known swivel is a high voltage swivel for offshore applications, for instance for distributing electrical power, that is generated on a weathervaning Floating Production, Storage and Offloading vessel (FPSO) which FPSO is anchored to the sea bed via a turret to a sub sea power cable.

Geostationary hydrocarbon or gas risers extend upwards from a well head to a power plant on the vessel, in which the hydrocarbons or gas are converted into electrical energy. The electrical connection of the rotating vessel to the stationary sub sea power cable leading to shore is achieved by the high voltage swivel in which the stator is connected, via the geostationary swivel part on the vessel, to the sub sea power cable and the rotor is connected to the power plant on the vessel.

The known swivel has the disadvantage that there is a risk of short circuits after the system has been in operational use for a while and the conductors start to show some wear. When debris originating from wear get in suspension in the dielectric oil or in the narrow space between the conductors and the insulating rings, short circuits can be created, causing the swivel to malfunction. Upon wear of the spring elements at the contact surfaces of the annular conductors, the solid insulator rings and conductors and the enclosure of the swivel need to be dismantled in order to obtain access to the electrodes.

Further, electrical swivel are provided with HV cables which have a very high bending radius and that require space to be bended.

In Direct Current (DC), the passage of electricity through liquids is generally accompanied by the chemical decomposition of the electrolyte. The metallic conductors through which the current enters and leaves the electrolyte are called electrodes. The electrode at high potential is called anode and the other at lower potential is called cathode. In fact, the passage of current through electrolytes is considered to take place through moving charged particles (ions) with positive ions moving towards the cathode, and negative ions moving towards the anode.

In Alternative Current (AC) those reactions are inhibited by the periodic inversion of the current direction leading to a balance of the positive and negative current over the time.

The present invention proposes a solution that provides an optimized electrical swivel adapted for offshore use, having a light and compact design, having a high efficiency and requiring low maintenance and where when using DC current, the problem of electrolysis is strongly limited.

SUMMARY OF THE INVENTION

The object of the present invention is to provide a high voltage swivel comprising a static and a rotating body, the static and rotating body being rotatable coaxial around a longitudinal axis, wherein the static and the rotating body are in electrical contact one with the other in order to allow transmission of power and/or data between the static and the rotating body, the static and the rotating body each having a contact surface for allowing the electrical contact between the static and the rotating body, wherein the electrical contact between the contact surfaces of static and the rotating body is obtained by using an electrical conductive fluid.

According to the present invention, it is possible that the electrical conductive fluid comprises electrolytes or is a metal liquid.

An electrolyte is any substance containing free ions that make the substance electrically conductive. The most typical electrolyte is an ionic solution, but molten electrolytes and solid electrolytes are also possible. When electrodes are placed in an electrolyte and a voltage is applied, the electrolyte will conduct electricity. Electrolytic conductors are used in electronic devices where the chemical reaction at a metal/electrolyte interface yields useful effects (i.e. in batteries, fuel cells etc. . . . ). An alternative to the use of an electrolyte as an electrical conductor is a liquid metal such as described in patent U.S. Pat. No. 4,623,514.

According to the present invention, it is possible that the contact surface of a first of the static and the rotating body comprises a ring shaped container, containing the conductive fluid.

According to the present invention, it is possible that the contact surface of a second of the static and the rotating body comprises an electrode which is in contact with the conductive fluid contained in the ring shaped container.

According to the present invention, the contact surface of the fixed conductor element is a conductive ring containing the substance comprising electrolytes or the metal liquid and the contact surface of the rotating conductor element is an electrode dipped into the substance comprising electrolytes or the metal liquid.

According to the present invention, it is possible that the space above the conductive fluid and between the static and the rotating body is insulated, by filling the available space with insulation material and the insulation material comprises glass, ceramic, plastic or resin based pieces or the insulation material comprises a fluid, such as dielectric oil.

Another advantage of the present invention is that the insulation between the static and the rotating body is realised by filling the space with insulation material such as plastic pieces or with dielectric oil, a continuous supply of dielectric oil being ensured via a reservoir placed above the swivel and filling it by gravity.

According to the present invention, it is possible that at least one of the static and rotating bodies comprises an electrode in the form of a tube, in the form of a plate or in the form of a ring.

According to the present invention, the electrodes may be in the shape of tubes, plates or rings, but other shapes can also achieve the conductive function.

According to the present invention, it is possible that the electrical conductive fluid is covered by a layer of high density and low conductivity liquid.

A further advantage of the present invention is to avoid contamination between the insulation material and the substance comprising electrolytes or the metal liquid by a layer of higher density than the dielectric oil and low conductivity liquid covering the substance contained in the contact surface of the fixed conductor element.

According to the present invention, it is possible that the contact elements of at least one of the static and rotating bodies is connected to a voltage line having a conductive core comprising an electrical conductive fluid surrounded by a flexible insulation cable.

According to the present invention each conductor element is connected to a voltage line via at least one connector, the voltage line being a flexible insulation cable filled in with electrolytes or metal liquid.

According to the present invention, it is possible that the contact surfaces of the static and rotating bodies are provided with synchronised switches and the synchronised switches are placed before and after the swivel in order to swap the positive and negative potentials in each conductors.

In order to avoid the problem of electrolysis when using DC current, the present invention proposes a solution based on synchronized switches. Further, in order to also avoid the electrolysis problem on the earth line, the electric contacts between the static and dynamic parts of the electric swivel made by friction track rings are replaced by standard bearings or rolling elements. Solutions proposed in this application aim to get a lighter and more compact electrical swivel design.

According to a second aspect of the present invention, the invention relates to a swivel stack assembly arranged and designed to be mounted on a turret which is carried within a vertical opening in the hull of a vessel via a bearing assembly, the turret having risers coupled thereto for the transport of product from the sea floor, wherein the swivel stack assembly comprises:

- a plurality of vertically spaced product swivels, each product swivel having a rotating body core and a static body mounted on said rotating body core; said rotating body core of said product swivels connected together to form a rotating body stack core, said rotating body stack core having a central bore and an upper end portion above an uppermost product swivel,
- bearing means for rotatively coupling said rotating body stack core to said turret for rotation with said vessel about said turret and said static body,
- a plurality of inlet product lines on said turret in fluid communication with said risers with each inlet product line coupled to at least one of said static body of said vertically stacked product swivels,
- a plurality of outlet product lines coupled to said rotating body cores and in fluid communication with at least one of said inlet product lines; each of said outlet product lines extending upwardly within said central bore and out said upper end portion of said rotating body stack core and above said uppermost product swivel thereof for transfer of product to storage areas of said vessel, and
- a high voltage swivel.

According to the present invention, it is possible that said swivel stack assembly comprises a non-product type, such as a water injection swivel and/or a gas lift swivel and/or a test swivel connected thereto with the product swivels to form a rotating body stack core.

According to a third aspect of the present invention, the invention relates to an offshore structure arranged and designed to comprise a swivel stack according to the invention.

BRIEF DESCRIPTION OF THE DRAWINGS

The invention will be further described below in connection with exemplary embodiments with reference to the accompanying drawings, wherein:

FIG. 1 shows a cross-sectional view of an FPSO vessel 1 that is moored in position by a mooring system 2. The FPSO vessel 1 comprises a turret 3 within and above its hull, and a fluid swivel 5 and an electrical swivel 4 on the turret 3. From the swivel 4 power is supplied through power supply line 6 to potential users. The electric supply can also be in reverse direction, from shore to the vessel.

FIG. 2 shows a cross-sectional view of a first embodiment of an electrical swivel 4 according to the invention where the conductive rings are concentric and on the same horizontal plane. The swivel 4 comprises a rotative upper cover 7 and a static shell 8, preferably a metal shell forming a chamber 9 for electrical connection. The upper cover 7 and a static shell 8 are sealed off by seals 10, 10' of any type such as U-shaped or V-shaped elastically deformable sealing rings. Further, the upper cover 7 lies on a bearing 11 to be able to rotate with regards to the static shell 8. In FIG. 2 there are shown three connectors 12 used to plug the electric cables 13 into the upper cover 7, these connectors 12 are used to avoid the formation of electric arcs, even when dealing with very high tension, temperature or pressure. The electric cables 13 have preferably electrolyte as a core conductor. Cables are much more flexible and comprise an insulation tube within which there is a dielectric liquid or flexible polymer such as XLPE and where the core is filled with a electrolyte or metal liquid. The benefit would be an extra short bending radius and therefore less room is required within the swivel stack and in the turret 3. Metallic conductor elements or electrodes 14 which are part of the rotative part 7 of the swivel 4 through which the current enters or leaves the chamber 9 are dipped into a substance 15, comprising electrolytes or metal liquid, contained in the contact surface of the fixed conductor elements or conductive rings 16 i.e. a circular groove having a gutter shape. Preferably, conductive rings 16 are made of copper. The electrodes 14 could be of any shape such as a tube, or a plate or a ring.

The electrolyte is any substance containing free ions that make the substance electrically conductive and can be of one of the following well known compositions: copper sulfate solution, silver sulphate solution, zinc sulphate solution.

As a theoretical ideal definition, the electrolyte shall be liquid, conductive, low resistivity, low permeability, massive enough (density above 2 to avoid mixing with other fluids of the swivel), non magnetic, chemically stable in respect of the surrounding and of the time. The electrolyte can also be a colloid, made of surfactant and nano particles.

The surfactant property would be mainly used as a physical attractive support of conductive particles, keeping the solution stable (a mix in suspension) over the time. The interest of the nano particles is the high electric conductivity and the low particle weight (limiting the magnetic and electromagnetic influences), and allowing to keep the particles in suspension in the liquid.

The electrolyte can be any liquid metal or a colloid remaining liquid at a temperature range between −200 and +200 deg. such as mercury, gallium alloy or Gallistan®, Bromide, Francium, cesium, rubidium, lead, Wood's metal or any alloy with low melting point.

Figure 6:
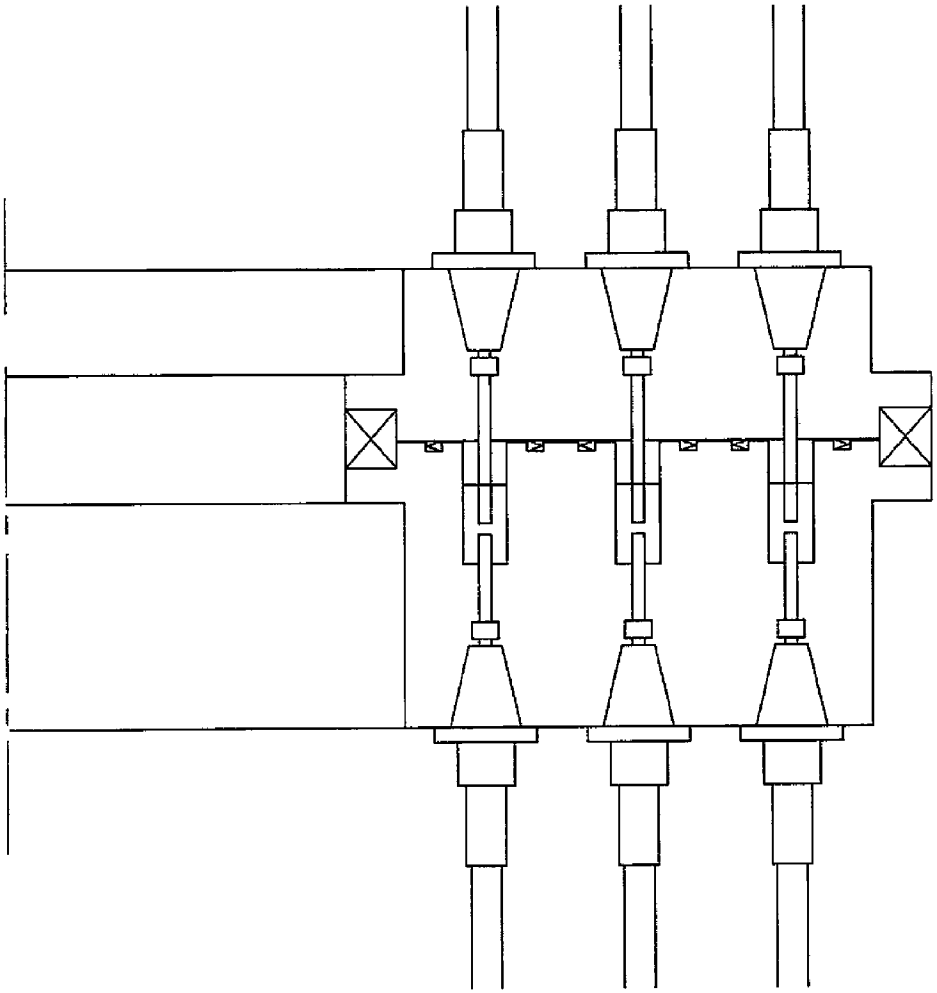
FIG. 6 shows a cross section view of a further embodiment, derived from FIG. 2 where the overall swivel bodies are insulative and have concentric circular grooves filled with electrolytes.

Electric cables 17, similar to electric cables 13, are connected via connectors 18, similar to connectors 12, to the conductive rings 16. In the embodiment shown in FIG. 6, the swivel body is made of isolative material, like glass or ceramic, or plastic or resin based. The various electric phases are respectively isolated by seals and an entrapped volume of dielectric oil 19 in the chamber 9, possibly under slight overpressure in respect of the electric path. Such a swivel has a limited number of main items: a fixed and a rotating part with one or two bearings. Using dielectric oil instead of insulation material pieces avoids sloshing of the electrolyte. Further, as shown, it is preferred to have a layer 21 of higher density liquid (higher than the electrolyte's density) above the substance comprising electrolyte to avoid mixing with dielectric oil applications. It also enables to ensure a good insulation. It is also possible to maintain a continuous supply of the dielectric oil using a reservoir (not shown). Accordingly, the maintenance is eased and does not require any dismantling of the swivel as it is possible to drain the electrolyte or the dielectric oil, supply the electrolyte or dielectric oil and evacuate possible gases just via conduits (not shown).

Alternatively, the liquid form of the electrolyte can be replaced by a gel or a powder.

Figure 1:
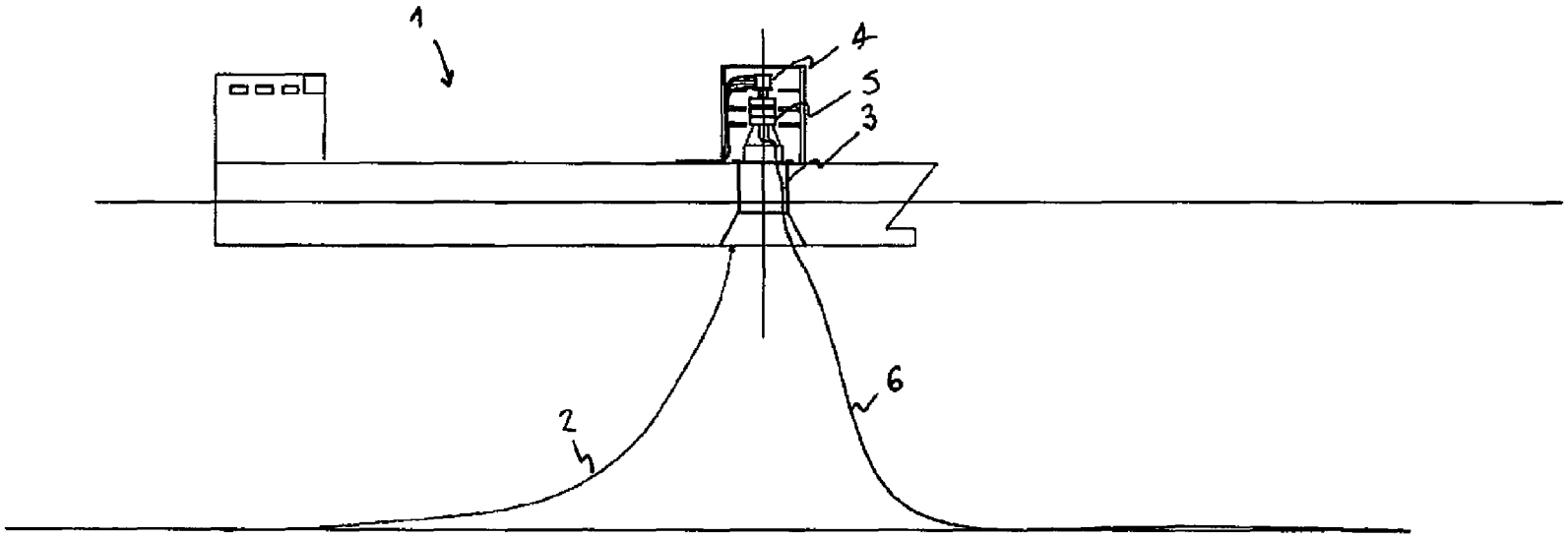
FIG. 1 shows a cross-sectional view of a possible overall system embodiment according to the present invention.
Figure 2:
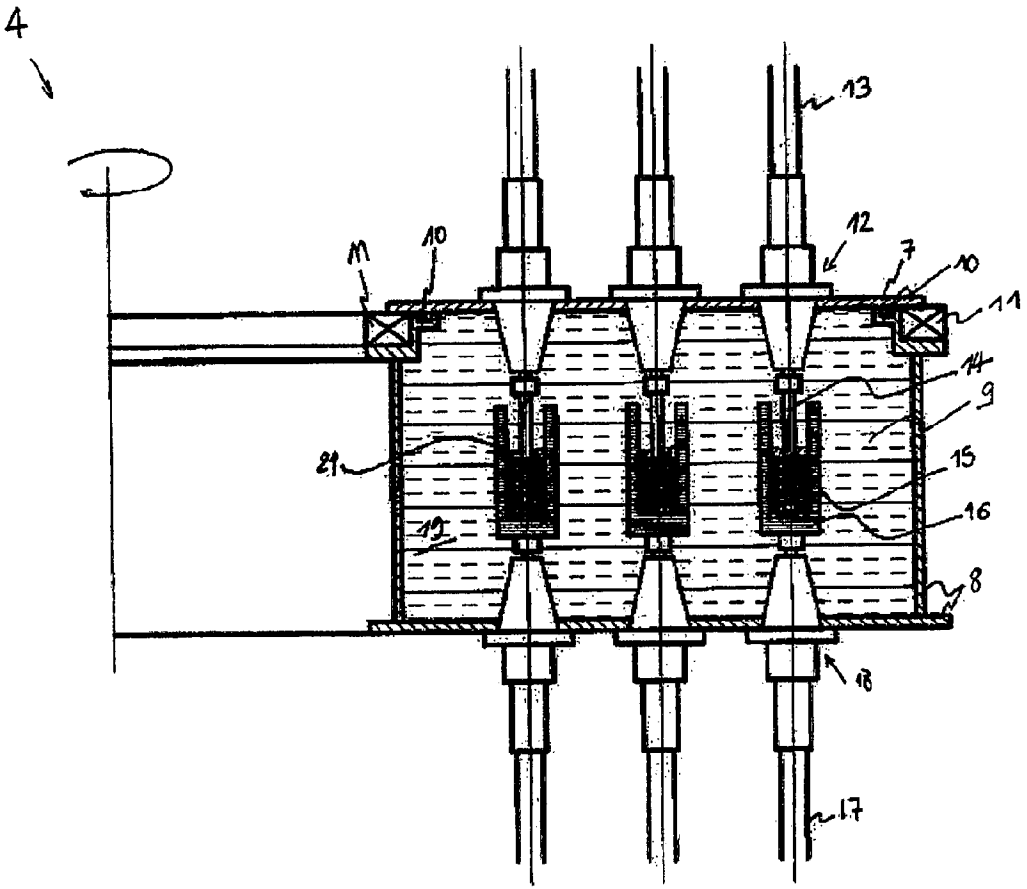
FIG. 2 shows a cross-sectional view of a first embodiment of an electrical swivel according to the invention where the conductive rings are concentric and on the same horizontal plane.
Figure 3:
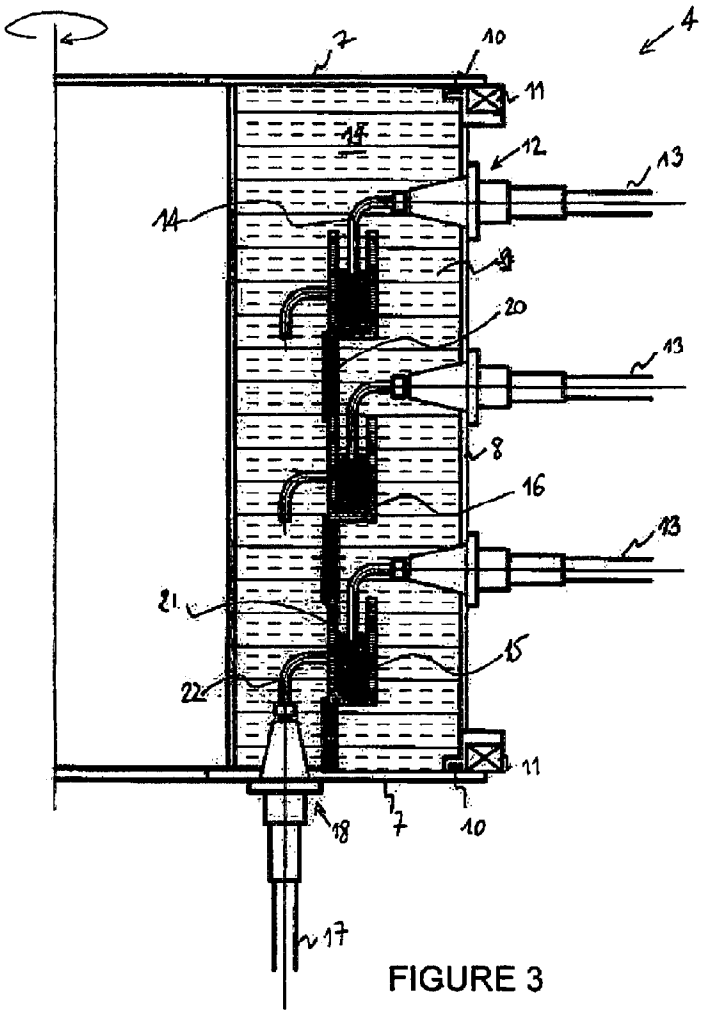
FIG. 3 shows a cross-sectional view of another embodiment of an electrical swivel according to the invention where the conductive rings are concentric and on the same vertical plane (i.e. stacked) with insulation support members placed in between each ring.

FIG. 3 shows a cross-sectional view of another embodiment of an electrical swivel according to the invention where the conductive rings 16 are concentric and on the same vertical plane (i.e. stacked) with insulation support members 20 placed in between each ring 16. In this embodiment, the connectors 18 are not directly in contact with the conductive rings 16 but are connected to the latest via a conductive bar 22 that can be made of copper for instance. It is to be noted that the conductive bar 22 could be a conductive cable.

Figure 4:
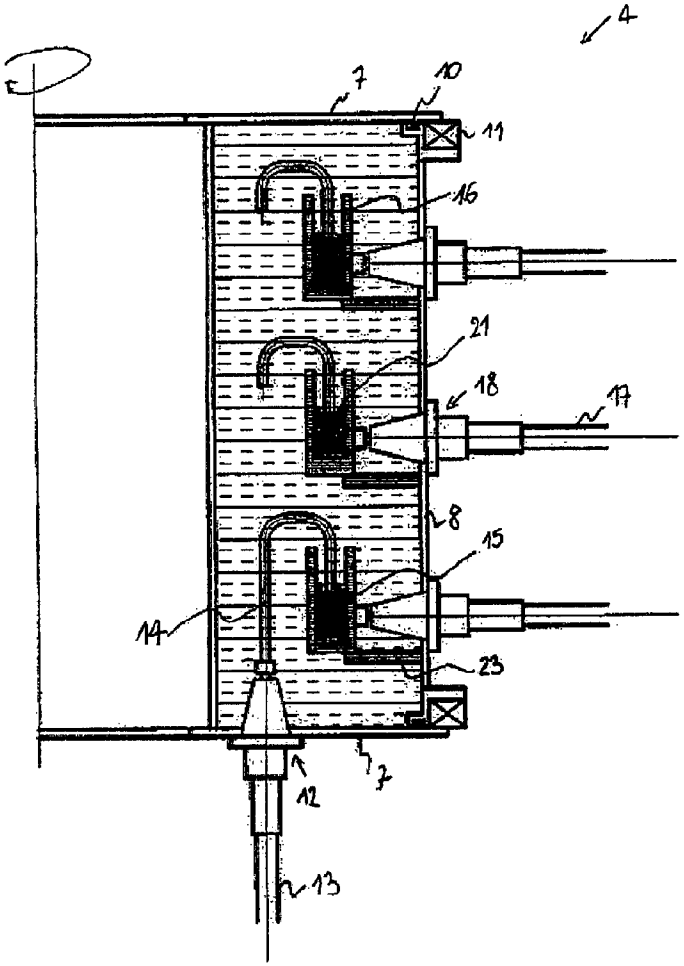
FIG. 4 shows a cross-sectional view of a further embodiment of an electrical swivel according to the invention where the conductive rings are concentric and on the same vertical plane (i.e. stacked) with insulation support members placed between each ring and the rotative body.

FIG. 4 shows a cross-sectional view of a further embodiment of an electrical swivel according to the invention where the conductive rings 16 are concentric and on the same vertical plane (i.e. stacked) with insulation support members 23 placed between each ring 16 and the static body 8. In this embodiment the electrodes 14 are in the shape of an inverted U-tube, one leg connected to the connector 12 and the other leg dipping in the substance 15 comprising electrolytes or metal liquid.

Figure 5B:
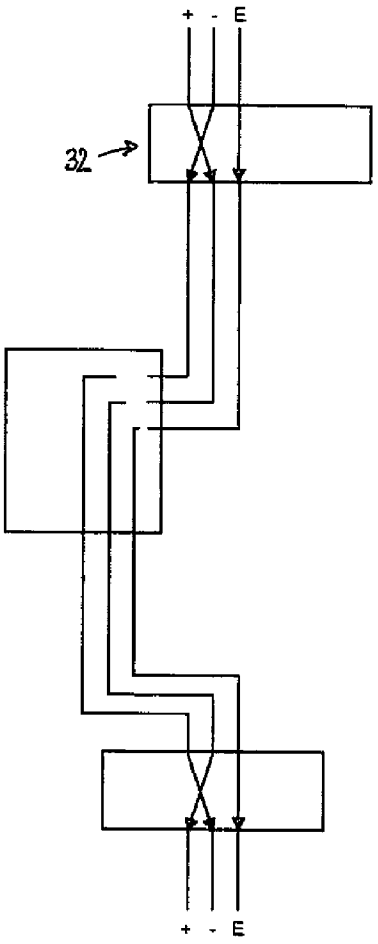
FIGS. 5*a* and 5*b* show a schematic electrical diagram of the arrangement of the synchronized switches provided in the conductor elements.
Figure 5A:
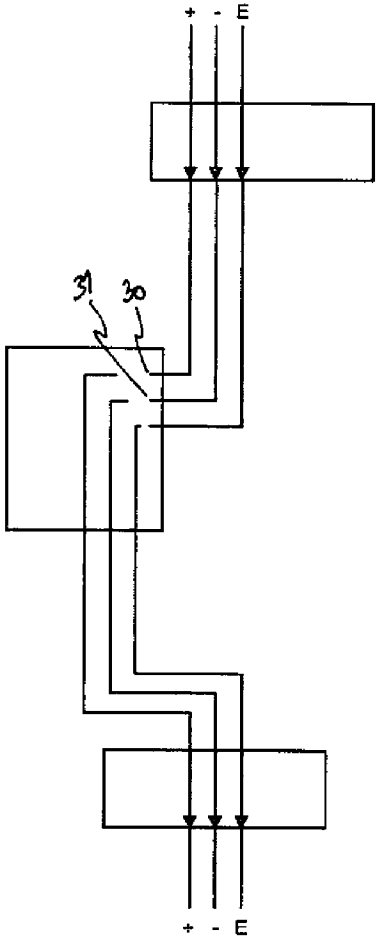

FIGS. 5*a* and 5*b* show a schematic electrical diagram of the arrangement of the synchronized switches provided in the conductor elements. When used in DC, a swivel, according to the present invention having a substance 15 comprising electrolytes or metal liquid as conductor presents risks of electrolysis through time. A solution to avoid this problem to occur is to provide the conductor elements with synchronized switches 32 and 33.

In FIG. 5*a*, the DC supply from cables 30 and 31 provides the energy necessary to create or discharge the ions in the electrolyte. Electric current is carried by electrons in the external circuit. In fact, when the direct electric current is passed through the substance 15, chemical reactions take place at the contacts between the circuit and the substance. In general, reduction takes place at the cathode (not shown) and oxidation takes place at the anode (not shown), this means that basically oxygen will be formed at the anode. This causes the anode to wear away while the cathode gains mass. The corrosion, that can be considered as the overall result of a specific type of electrolysis, on the anode can be limited if electrodes are switched such that the electrode is from time to time the anode and from time to time the cathode. According to the present invention, the conductor elements are provided with synchronized switches that are placed before and after the swivel, in order to swap the positive and negative potentials in each conductor so that over the time each conductor is subject to an equal amount of positive and negative charges.

In FIG. 5*b* it appears clearly that electrode after the switch is the cathode (and not the anode as shown in FIG. 5*a*). Therefore, the corrosion will occur from time to time on one electrode and from time to time on the other electrode. As there is no switch possible for the earth line E (if the switch is installed between the electrodes), to avoid corrosion on the earth line, the electrolyte contact can be replaced by a standard bearing. In that way the earth line is not in contact with the substance 15 and protected from electrolysis and hence from corrosion while the electric contacts between the static and dynamic parts of the electric swivel are made by bearings or rolling elements. The contact surfaces are the linear contact of the roller on the bearing track and also the flat surface of the side of the roller on the side of the track. Other bearings arrangements offer also a large amount of contact surface, ball bearings and needle bearings etc. Those contacts are by definition spread uniformly on the circumference.

Furthermore, those bearings can be supplied with the rollers being mechanically pre-constrained between the inner and outer rings. Equally spaced machining can be done on the inner or outer ring of the bearing to fit some supporting and contact lugs. If the supporting is made by the inner ring, then the outer ring needs only a driving system and some cables or contact lugs to carry on the electric current.

According to the present invention, the electrical contact between the contact surfaces of the fixed and rotating conductor elements is ensured by standard bearings or rolling elements only, no substance comprising electrolytes is used.

Another way of achieving the contact between the inner and the outer parts of the swivel is the use of a ring (preferably concentric to the swivel stack axis), a conductive belt (cross section circular or flat) and a pinion. This also offers high exchange surfaces for the electric contact and no wear and debris since it is turning elements. If we assume the inner parts and inner ring to be fixed, when the outer shell rotates the mounted on pinion will revolve around the inner ring, leading the belt to turn also. The pinion shall have a conductive bearing. The electric current with then pass from the static ring to the dynamic pinion. This enables to decrease the wear of the components while increasing the contact surface between the inner and the outer parts of the swivel with a uniform mechanical constraint (high mechanical constrain provides an electric contact with far less resistance). As a result the swivel according to the present invention has no wear, no debris and constant performances over the service time.

Figure 7:
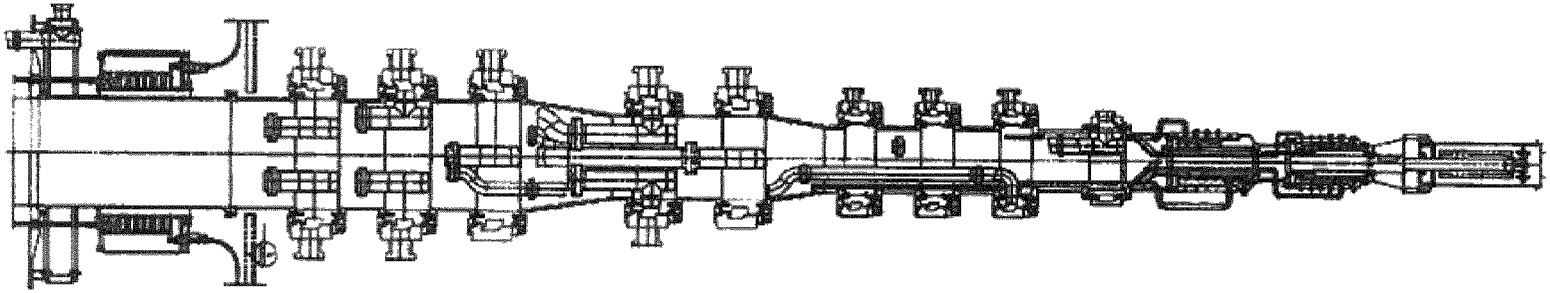
FIG. 7 shows a swivel stack of an electrical swivel where the HV swivel is integrated at the bottom of the swivel stack according to an embodiment of the present invention.

FIG. 7 shows a swivel stack of an electrical swivel where the HV swivel is integrated at the bottom of the swivel stack. The swivel stack is very similar to known swivel stacks, arranged and designed to be mounted on a turret carried within a vertical opening in the hull of a vessel via a bearing assembly, the turret having risers coupled thereto for the transport of product from the sea floor. The swivel stack assembly comprises:

at least a plurality of vertically spaced product swivels, each product swivel having a rotating body core and an static body mounted on said rotating body core; said rotating body core of said product swivels connected together to form a rotating body stack core, said rotating body stack core having a central bore and an upper end portion above an uppermost product swivel;

bearing means for rotatively coupling said rotating body stack core to said turret for rotation with said vessel about said turret and said static body;

a plurality of inlet product lines on said turret in fluid communication with said risers with each inlet product line coupled to at least one of said static body of said vertically stacked product swivels; and a plurality of outlet product lines coupled to said rotating body cores and in fluid communication with at least one of said inlet product lines; each of said outlet product lines extending upwardly within said central bore and out said upper end portion of said rotating body stack core and above said uppermost product swivel thereof for transfer of product to storage areas of said vessel.

It has been common in the past to place product lines from the turret inside the inner core of the swivel stack via the bottom of the swivel stack. In such prior arrangements, the inner core of the swivel stack was fixed with respect to the turret; the outer housing rotated with the vessel with its product lines running to storage holds of the vessel. In a typical swivel stack, power and signal swivel are located at the top of the swivel stack above the gas (lift and import) swivels, the test swivel, the oil export swivel and production swivels. In this particular embodiment, the power swivel or high voltage swivel is located at the bottom of the swivel stack, hence the connection of the cable is made at the bottom of the swivel stack which avoids to have the cables going through the whole stack up to the top.

The integration of the HV swivel is made at the bottom of the swivel stack which provides many advantages such as it eases the installation of the electric cables, it avoids the risk to damage cable during installation, it enables to change HV cables during lifetime, it also avoids to apply de-rating on HV cables due to swivel stack internal temperature. As a result the swivel according to the present invention is smaller and lighter with a reduction of the seal diameter for upper swivels.

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. A high voltage swivel comprising:

a static body; and a rotating body, the static body and the rotating body being rotatable coaxial around a longitudinal axis;

wherein the static body and the rotating body are in electrical contact one with the other in order to allow transmission of power and/or data between the static body and the rotating body;

wherein the static body and the rotating body each comprise a contact surface for allowing electrical contact between the static body and the rotating body;

wherein electrical contact between the contact surfaces of the static body and the rotating body is obtained by using an electrical conductive fluid; and wherein the electrical conductive fluid is covered by a layer of a high density and low conductivity liquid.

2. The high voltage swivel according to claim 1, wherein the electrical conductive fluid comprises electrolytes or is a metal liquid.

3. The high voltage swivel according to claim 1, wherein the contact surface of a first of the static and the rotating body comprises a ring shaped container, containing the conductive fluid.

4. The high voltage swivel according to claim 3, wherein the contact surface of a second of the static body and the rotating body comprises an electrode which is in contact with the conductive fluid contained in the ring shaped container.

5. The high voltage swivel according to claim 1, wherein the space above the conductive fluid and between the static body and rotating body is insulated, by filling the available space with an insulation material.

6. The high voltage swivel according to claim 5, wherein the insulation material comprises at least one of glass, ceramic, plastic or resin based pieces.

7. The high voltage swivel according to claim 5, wherein the insulation material comprises a fluid, such as a dielectric oil.

8. The high voltage swivel according to claim 7, wherein the swivel is provided with a supply of the dielectric oil in order to continuously fill the space available for the insulation material with the dielectric oil.

9. The high voltage swivel according to claim 4, wherein at least one of the static body and the rotating body comprises an electrode in the form of a tube.

10. The high voltage swivel according to claim 4, wherein at least one of the static body and the rotating body comprises an electrode in the form of a plate.

11. The high voltage swivel according to claim 4, wherein at least one of the static body and the rotating body comprises an electrode in the form of a ring.

12. The high voltage swivel according to claim 1, wherein the contact elements of at least one of the static body and the rotating body is connected to a voltage line having a conductive core comprising an electrical conductive fluid surrounded by a flexible insulation cable.

13. The high voltage swivel according to claim 12, wherein the flexible insulation cable comprises a flexible polymer.

14. The high voltage swivel according to claim 1, wherein the contact surfaces of the static body and the rotating body are provided with synchronised switches.

15. The high voltage swivel according to claim 14, wherein the synchronised switches are placed before and after the swivel in order to swap the positive and negative potentials in each conductors.

16. The high voltage swivel according to claim 1, wherein the high voltage swivel is integrated at a bottom of a swivel stack.

17. A swivel stack assembly arranged and designed to be mounted on a turret which is carried within a vertical opening in a hull of a vessel via a bearing assembly, the turret comprising risers coupled thereto for the transport of product from a sea floor, the swivel stack assembly comprising:

a plurality of vertically spaced product swivels, each product swivel comprising a rotating body core and a static body mounted on said rotating body core; said rotating body core of said product swivels connected together to form a rotating body stack core, said rotating body stack core having a central bore and an upper end portion above an uppermost product swivel;

bearing means for rotatively coupling said rotating body stack core to said turret for rotation with said vessel about said turret and said static body;

a plurality of inlet product lines on said turret in fluid communication with said risers with each inlet product line coupled to at least one of said static body of said vertically stacked product swivels;

a plurality of outlet product lines coupled to said rotating body cores and in fluid communication with at least one of said inlet product lines; each of said outlet product lines extending upwardly within said central bore and out said upper end portion of said rotating body stack core and above said uppermost product swivel thereof for transfer of product to storage areas of said vessel; and a high voltage swivel according to claim 1.

18. The swivel stack assembly according to claim 17, wherein said swivel stack assembly comprises a non-product type, such as a water injection swivel and/or a gas lift swivel and/or a test swivel connected thereto with product swivels to form a rotating body stack core.

19. An offshore structure arranged and designed to comprise a swivel stack as claimed in claim 17.

20. A high voltage swivel comprising:

a static body;

a rotating body, the static body and the rotating body being rotatable coaxial around a longitudinal axis;

wherein the static body and the rotating body are in electrical contact one with the other in order to allow transmission of power and/or data between the static body and the rotating body;

wherein the static body and the rotating body each comprise a contact surface for allowing electrical contact between the static body and the rotating body;

wherein electrical contact between the contact surfaces of the static body and the rotating body is obtained by using an electrical conductive fluid; and wherein the contact elements of at least one of the static body and the rotating body is connected to a voltage line having a conductive core comprising an electrical conductive fluid surrounded by a flexible insulation cable.

21. A high voltage swivel comprising:

a static body;

a rotating body, the static body and the rotating body being rotatable coaxial around a longitudinal axis;

wherein the static body and the rotating body are in electrical contact one with the other in order to allow transmission of power and/or data between the static body and the rotating body;

wherein the static body and the rotating body each comprise a contact surface for allowing electrical contact between the static body and the rotating body;

wherein electrical contact between the contact surfaces of the static body and the rotating body is obtained by using an electrical conductive fluid; and wherein the contact surfaces of the static body and the rotating body are provided with synchronised switches.

* * * * *